US007051494B2

(12) United States Patent
Konno et al.

(10) Patent No.: US 7,051,494 B2
(45) Date of Patent: May 30, 2006

(54) FILLING METHOD, FILLING MACHINE AND PACKAGING MATERIAL THEREFOR

(75) Inventors: Hidetoshi Konno, Tokyo (JP); Yasuyuki Moriyama, Tokyo (JP)

(73) Assignee: Tetra Laval Holdings & Finance S.A., Pully (CH)

( * ) Notice: Subject to any disclaimer, the term of this patent is extended or adjusted under 35 U.S.C. 154(b) by 21 days.

(21) Appl. No.: 10/475,018

(22) PCT Filed: Apr. 12, 2002

(86) PCT No.: PCT/JP02/03646

§ 371 (c)(1),
(2), (4) Date: Mar. 8, 2004

(87) PCT Pub. No.: WO02/085710

PCT Pub. Date: Oct. 31, 2002

(65) Prior Publication Data

US 2005/0060961 A1 Mar. 24, 2005

(30) Foreign Application Priority Data

Apr. 16, 2001 (JP) ..... 2001-116529

(51) Int. Cl.
*B65B 9/20* (2006.01)
*B65B 41/12* (2006.01)

(52) U.S. Cl. ..... 53/451; 53/389.2

(58) Field of Classification Search ..... 53/451, 53/551, 552, 389.2; 156/157, 159, 502, 504
See application file for complete search history.

(56) References Cited

U.S. PATENT DOCUMENTS

| | | | | | |
|---|---|---|---|---|---|
| 4,848,063 | A | * | 7/1989 | Niske | 53/451 |
| 4,881,360 | A | * | 11/1989 | Konzal et al. | 53/451 |
| RE33,467 | E | * | 12/1990 | Steck et al. | 53/451 |
| 5,388,387 | A | * | 2/1995 | McElvy | 53/451 |
| 6,041,574 | A | * | 3/2000 | Bennett | 53/451 |
| 6,076,337 | A | * | 6/2000 | Sunter et al. | 53/552 |

FOREIGN PATENT DOCUMENTS

| | | |
|---|---|---|
| JP | 43-22879 | 9/1968 |
| JP | 63-55027 | 3/1988 |
| JP | 6-27509 | 4/1994 |

* cited by examiner

*Primary Examiner*—John Sipos
(74) *Attorney, Agent, or Firm*—Buchanan Ingersoll PC

(57) ABSTRACT

When using web-shaped packaging material in which the rear end of a packaging material is spliced to the front end of a next web-shaped packaging material, in order to continuously operate the filling machine for paper container, notches are provided on a corner portion of the paper spliced portion around the metal layer. Even if a paper spliced portion is included in the web-shaped packaging material, in the filling machine seal insufficiency is not generated in the longitudinal seal of the paper spliced portions, and an interruption due to the broken part of continuous operation is prevented.

10 Claims, 6 Drawing Sheets

FILLING METHOD, FILLING MACHINE AND PACKAGING MATERIAL THEREFOR

FIELD OF THE INVENTION

This invention relates to a method for filling a paper drink container, a filling machine and a packaging material to use in the filling machine.

BACKGROUND ART

Paper drink containers are fabricated, in a filling machine, by unwinding a web-shaped packaging material from a roll or a reel continually, forming the material into a tube shape by longitudinal sealing, introducing drink contents, sealing the tube, and cutting the tube into individual containers. Before the web of the roll- or reel-shaped packaging material is used up, the next roll is supplied.

The forward packaging material and the backward packaging material are spliced. A paper-spliced portion which is spliced is disposed as a paper container including the paper spliced portion in the filling machine.

However, seal insufficiency is generated in the longitudinal seal corresponding to the paper-spliced portion and the part is broken.

An interruption of the continuous running of the web may thus be necessary. When the continuous running of filling machine is stopped, for a re-start, considerable time and cost are needed in re-setup of the packaging material and cleaning and sterilization.

DISCLOSURE OF THE INVENTION

It is for this purpose of the invention to provide a filling method of paper drink containers, a filling machine and a packaging material, wherein even if the paper spliced portion is included in the web-shaped packaging material, seal insufficiency is not generated in the longitudinal seal of the paper spliced portion, and an interruption due to the broken part of continuous operation is prevented.

A filling method by this invention comprises splicing a front end portion of a web-shaped packaging material of the next the reel with a rear end portion of a web of an in-use reel to form a paper spliced portion, unwinding the web-shaped packaging material from the reel continually, longitudinal sealing the web packaging material including a metallic material layer having an electromagnetic property to form the web into a tube shape, filling liquid food, transversal sealing the tube packaging material to cut the seal, and folding the seal flap to form a paper container. The web-shaped packaging material is longitudinal sealed in the electromagnetic induction heating to be formed into the tube shape, and notches are formed in the metallic material layer of a web edge corner portion heated with electromagnetic induction heating of the paper spliced portion.

A filling machine by this invention splices a front end portion of a web-shaped packaging material of the next reel with a rear end portion of a web of an in-use reel to form a paper spliced portion, unwinds the web-shaped packaging material from the reel continually, longitudinal seals the web packaging material including a metallic material layer having an electromagnetic property to form the web into a tube shape, fills liquid food, transversal seals the tube packaging material to cut the seal, and folds the seal flap to form a paper container. The machine includes a longitudinal seal apparatus to longitudinal seal the web-shaped packaging material and form it into the tube shape with electromagnetic induction heating of one part or all of the metallic material layer, and a notch formation apparatus forming notches in the metallic material layer of a web edge corner portion heated with electromagnetic induction heating of the paper spliced portion.

Packaging material in accordance with this invention used by the filling machine which splices a front end portion of a web-shaped packaging material of the next the reel with a rear end portion of a web of an in-use reel to form a paper spliced portion, unwinds the web-shaped packaging material from the reel continually, longitudinal seals the web packaging material including a metallic material layer having an electromagnetic property to form the web into a tube shape, fills liquid food, transversal seals the tube packaging material to cut the seal, and folds the seal flap to form a paper container. The packaging material includes notches in the metallic material layer of a web edge corner portion heated with electromagnetic induction heating of the paper spliced portion.

Another filling method in accordance with this invention involves splicing a front end portion of a web-shaped packaging material of a next the reel with a rear end portion of a web of an in-use reel to form a paper spliced portion, unwinding the web-shaped packaging material from the reel continually, longitudinal sealing the web packaging material including a metallic material layer having an electromagnetic property to form the web into a tube shape, filling liquid food, transversal sealing the tube packaging material to cut the seal, and folding the seal flap to form a paper container. One part or all of the metallic material layer is heated with electromagnetic induction, an end of the web-shaped packaging material is protected in strip tape with seals and, notches are formed in the metallic material layer of a web edge corner portion heated with electromagnetic induction heating of the paper spliced portion.

THE BEST MODE FOR CARRYING OUT THE INVENTION

A filling machine of the present invention, a filling method and packaging material are explained by the drawings of embodiment.

Figure 3:
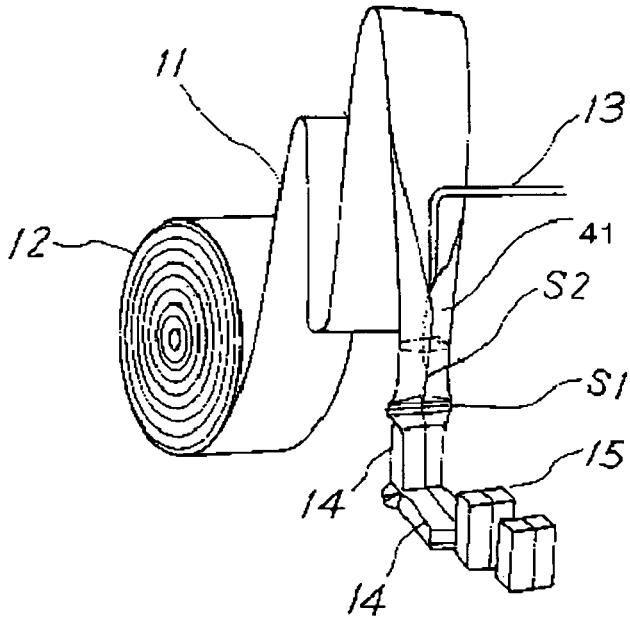
FIG. 3 is a schematic view of the filling machine of an embodiment of the present invention.

In the filling machine for manufacturing the packaging container which is filled with liquid food such as milk and soft drinks, web-shaped packaging material is supplied by a reel, the web is formed into a tube-shape continually, and liquid food is filled into the tube packaging material. In FIG. 3, the packaging material is supplied in a condition of a reel 12, is supplied from a packaging material supplying portion, and is transported into the filling machine in a web shape. The packaging material 11 is formed by longitudinal cutting of base paper and, crease lines are preformed.

The packaging material 11 from the packaging material supplying portion is supplied by the guide-rollers in the filling machine into a sterilization room and is sent to an air knife portion. While the packaging, material 11 is transported in the air knife department, by means of a hot jet, sterilizers are removed from the packaging material 11.

The packaging material 11 from an air knife portion is guided by means of a guide roller. While the packaging material is guided by means of forming rings as a packaging material tube formation means, the packaging material is made to curve and is formed as a tube. Tube packaging material 41 is formed by longitudinal sealing with the longitudinal seal apparatus. While the packaging material tube 41 is transported downwards, liquid food is supplied from a filling pipe 13, and is filled in the packaging material tube 41.

The packaging material tube 41 is sent to a transversal seal apparatus. In the transversal seal apparatus, a transversal seal portion is formed by nipping from both sides and forming a transversal seal every predetermined distance. In the transversal seal portion, the packaging material tube 41 is cut with a cut apparatus and is separated into a pillow-shaped, bag-shaped container 14. The container 14 is formed as a predetermined shape in line with crease lines, and with a final forming apparatus the packaging container 15 is completed.

The splicing is needed in order to operate a filling machine continuously. The method of splicing is now explained.

Figure 6:
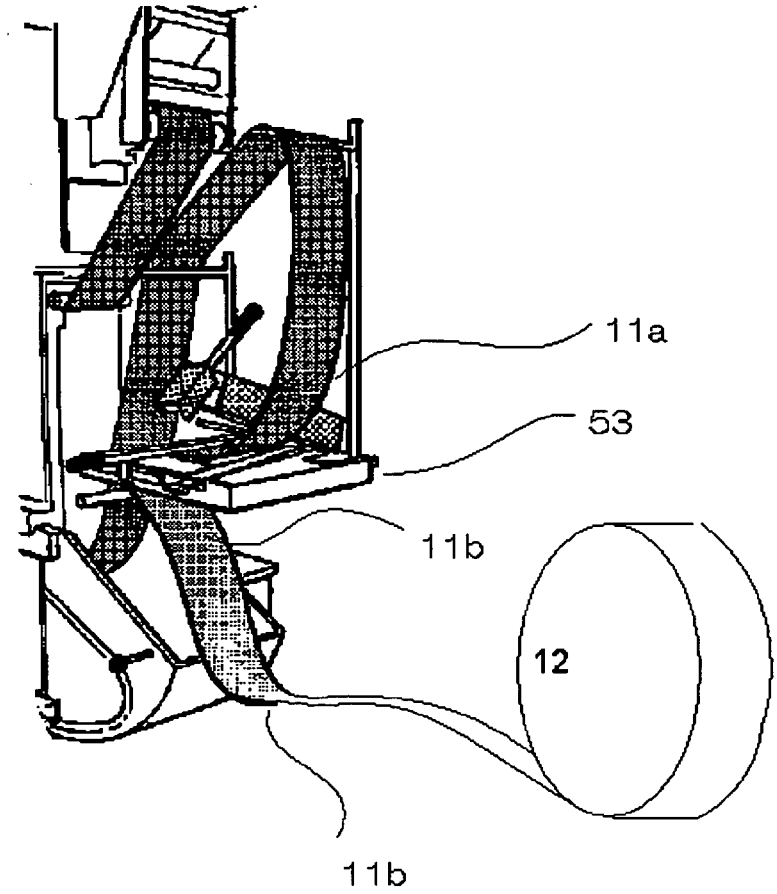
FIG. 6 is the perspective view which shows the paper packaging material feeding section which splices in the next paper packaging material reel in a paper packaging material reel using in filling machine of an embodiment of the present invention.

As shown in FIG. 6, the packaging material is supplied as currently used packaging material 11 in a packaging material supply portion of the filling machine from the reel.

Figure 7A:
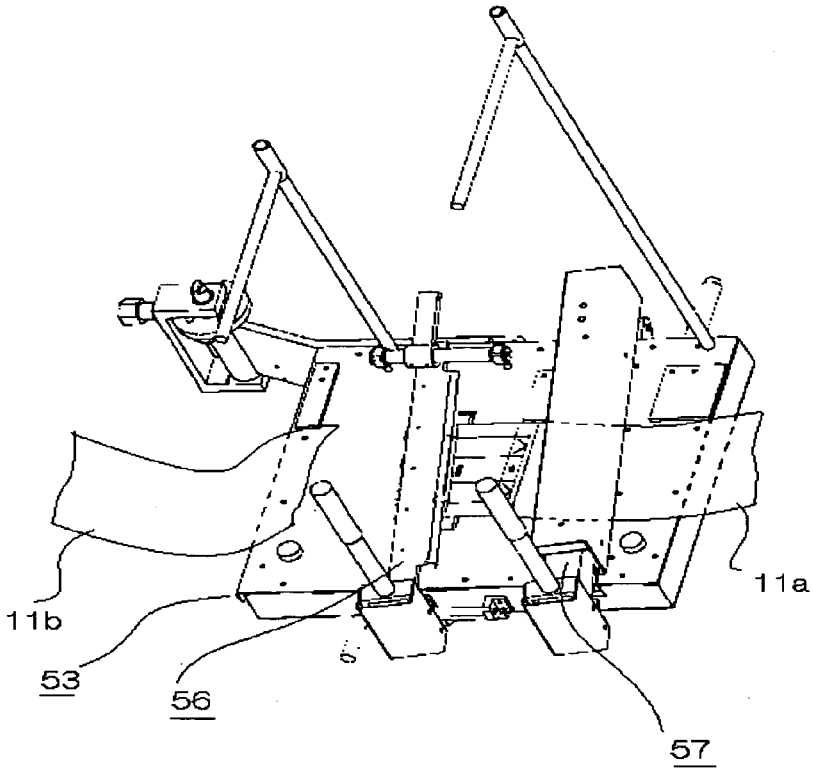
FIG. 7 is an exploded perspective view showing a splice table to splice the next paper packaging material to a using paper packaging material in the paper packaging material feed portion of the filling machine of an embodiment of the present invention.

When the current reel has little packaging material left, the next packaging material 11*b* is spliced. All the currently used packaging material 11*a* is unwound from the reel with reversing of the reel of the currently used packaging material 11*a*. A forward (front) end portion of packaging material 11*b* of reel 12 to be used next is set at splice table 53. A rear end portion of the removed packaging material 11*a* is overlapped on a front end portion of the packaging material 11*b* from the next reel and is set. As shown in FIG. 7A, the next packaging material 11*b* and the used packaging material 11*a* are spliced by heating and pressuring with a heating pressuring portion 57 on the splice table 53. The packaging material 11*b* to be used next is loaded immediately to the packaging material supply portion, and the filling machine is run continually. After the content liquid is filled, paper containers including the paper part which is spliced are detected automatically and are disposed.

Figure 4:
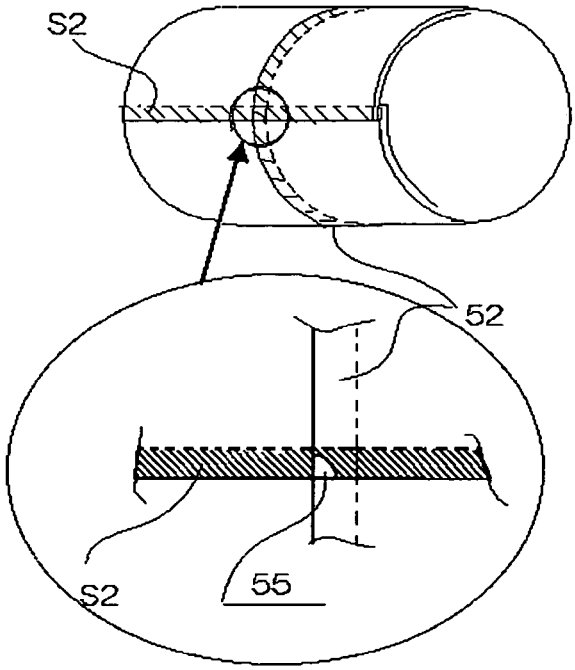
FIG. 4 is an enlarged perspective diagram which explains a longitudinal seal part of a tube-shape web packaging material.

An embodiment of the present invention about paper splicing is explained. When longitudinal sealing of paper packaging material is done by heating with induced current and when the seal is done heating with induced current so that an end face of paper packaging material is seal-protected with a strip tape, for example, an electromagnetism induction material in the form of a metal layer such as aluminum foil or a copper foil is used. In, for example, the part having aluminum foil discontinuity, that is, a paper spliced portion of the packaging material, as shown in an enlarged view of FIG. 4 explaining the longitudinal seal portion S2 of the tube formed paper packaging material, a part 55 where induction heating is lacking at a corner edge of the paper spliced portion 52 is formed. The lack of this induction heating causes an insufficient seal, a container breakage is is generated in the filling, and the filling machine is stopped.

Figure 1:
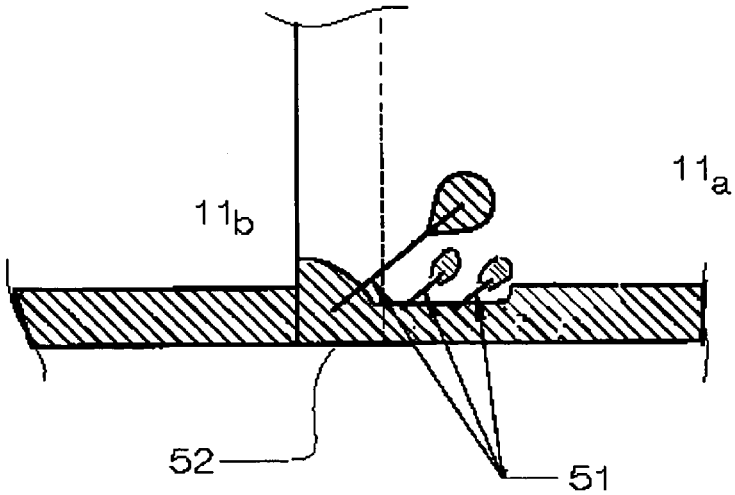
FIG. 1 is a plane view showing the paper packaging material of an embodiment of the present invention that a notch is formed by an end portion of the paper spliced portion heated with electromagnetic induction.
Figure 2:
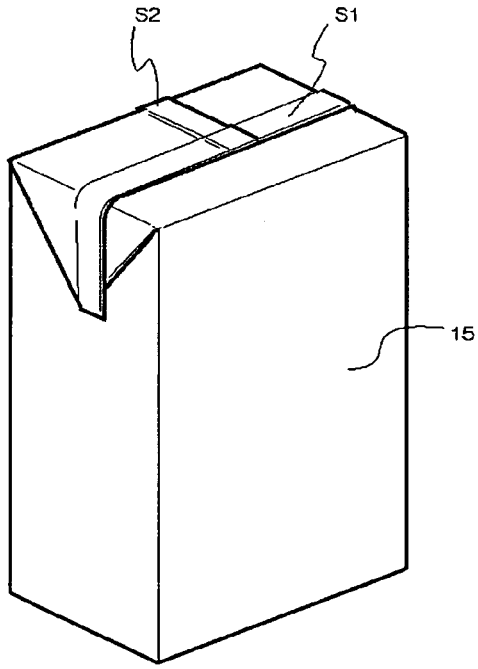
FIG. 2 is a perspective diagram of an example of paper container provided in accordance with an embodiment of the present invention.

Means to resolve the lack of induction heating in a longitudinal seal portion of a corner edge of the paper spliced portion are shown with the present invention. As shown in FIG. 1, notches are arranged in the aluminum foil of the splicing paper portion. By means of a phenomenon that induced current can be easily generated in notch points, induction heating covers the portion lacking aluminum foil with induced current generated at the notches. Therefore, continuity of longitudinal seal can be kept by means of forming notch 51 as shown in FIG. 1. Although the width of a heating region for plural notches of FIG. 1 is smaller than the width of the seal zone of the next packaging material 11*b*, because this enforcement keeps the continuity of longitudinal seal, the purpose is met.

The embodiment that three notches 51 formed at the edge of the discontinuous portion is shown in FIG. 1.

Figure 5:
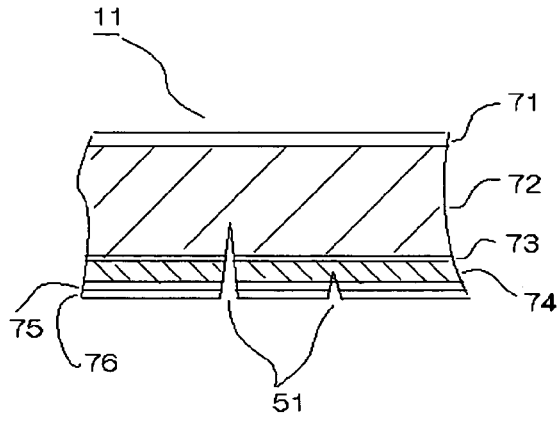
FIG. 5 is a sectional view of an edge of a paper spliced portion of the paper packaging material that a notch was formed by an embodiment of the present invention.

One notch 51 or a lot of notches are acceptable. Furthermore, the notch 51 can include a notch penetrating through aluminum foil 73 and a notch extending to the middle of the aluminum foil as shown in FIG. 5. Depending upon the situation involving lack of heat and discontinuous longitudinal seal, the number and length of a notch and the shape may be designed. Many conditions such as a kind of paper packaging material and the thickness of aluminum foil and load voltage are considered. When the currently used packaging material and the next packaging material are spliced in the paper spliced portion of the filling machine by means of a notch formation apparatus arranged at splice table, desired notches are formed. Seal insufficiency caused by discontinuity of the aluminum foil of a paper spliced portion by the notches is solved.

When the strip tape is formed in web-shaped packaging material by a method in the same way as longitudinal sealing of the paper packaging material, a lack of seal caused by discontinuity of the aluminum foil of a paper spliced portion is solved.

The packaging material 11 is formed from the outside of the packaging container to an inside sequentially as follows, an outside layer 71, a paper substrate 72, barrier layer 74, adhesive layer 73, 75 and an innermost layer 76.

By means of a notch formation apparatus arranged at a splice table by this invention, an embodiment for providing the desired notches is explained.

Figure 7B:
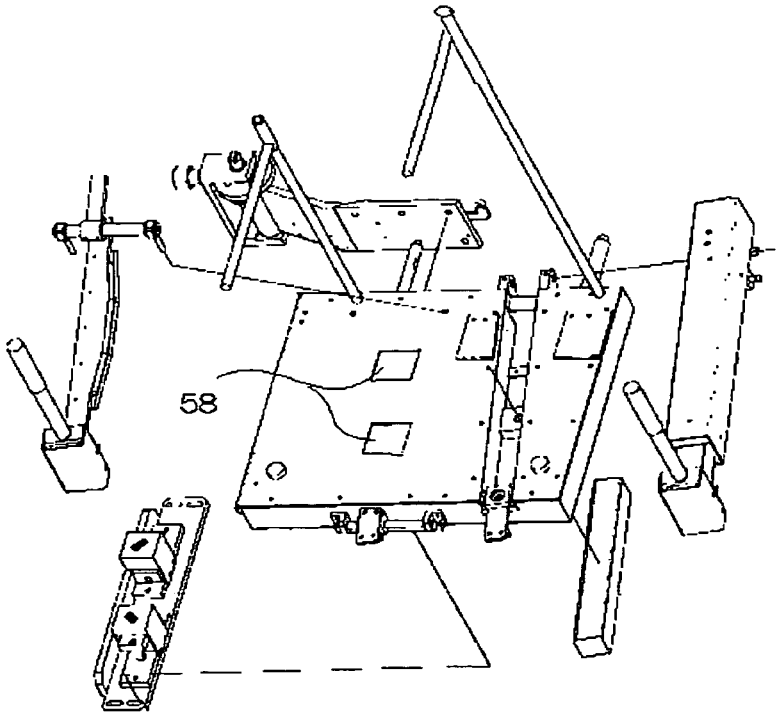

As shown in FIG. 7A, a rear end portion of the currently used packaging material 11*a* is fixed in a fixing portion for notch formation 56 on the splice table 53. As shown in FIG. 7B, an opening 58 for notch blades is arranged in the splice table 53.

Figure 8:
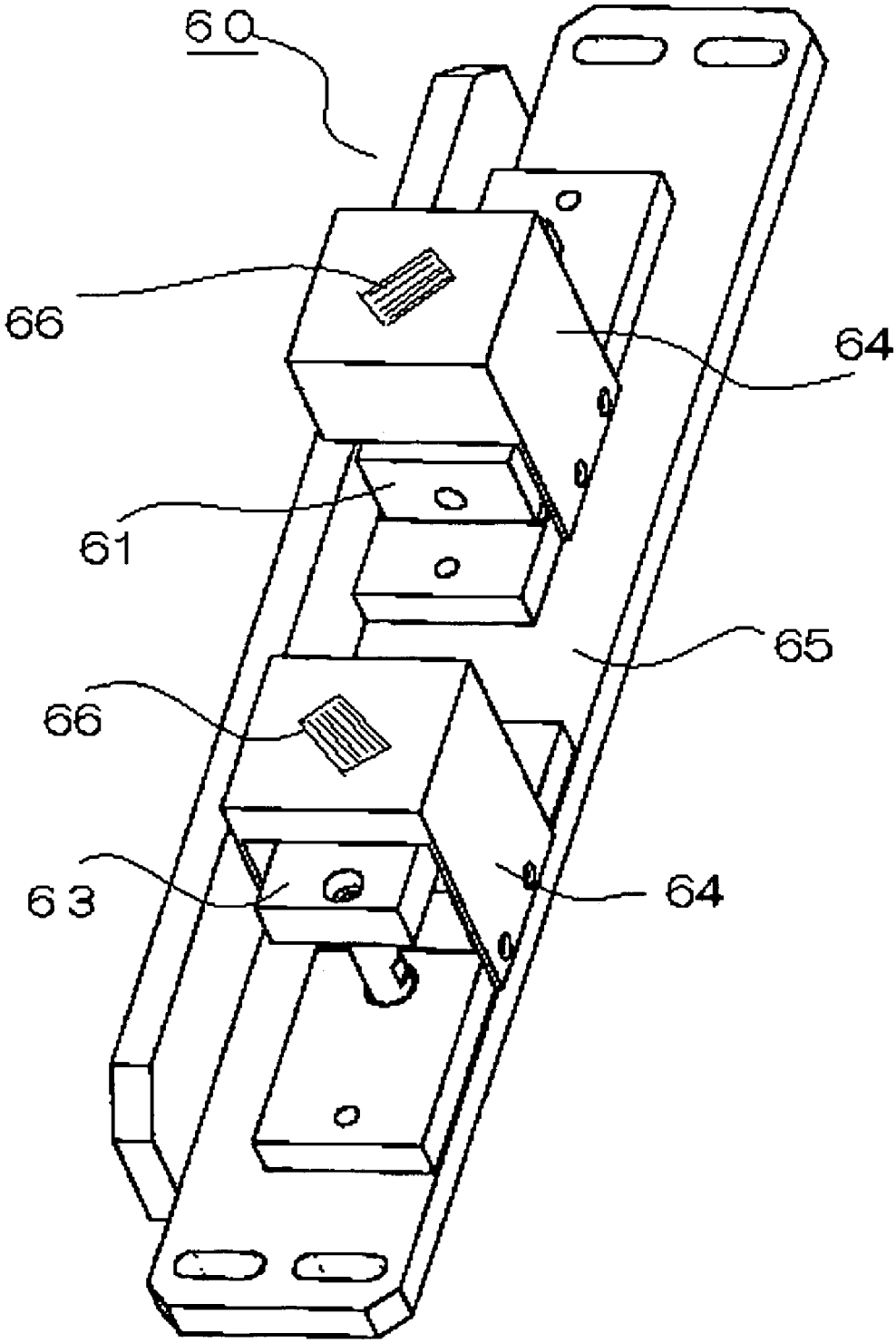
FIG. 8 is the perspective view which shows a structure of slit device to form notches on a splice table to splice the next paper packaging material to the using paper packaging material in the paper packaging material feed portion of filling machine of an embodiment of the present invention.
Figure 9:
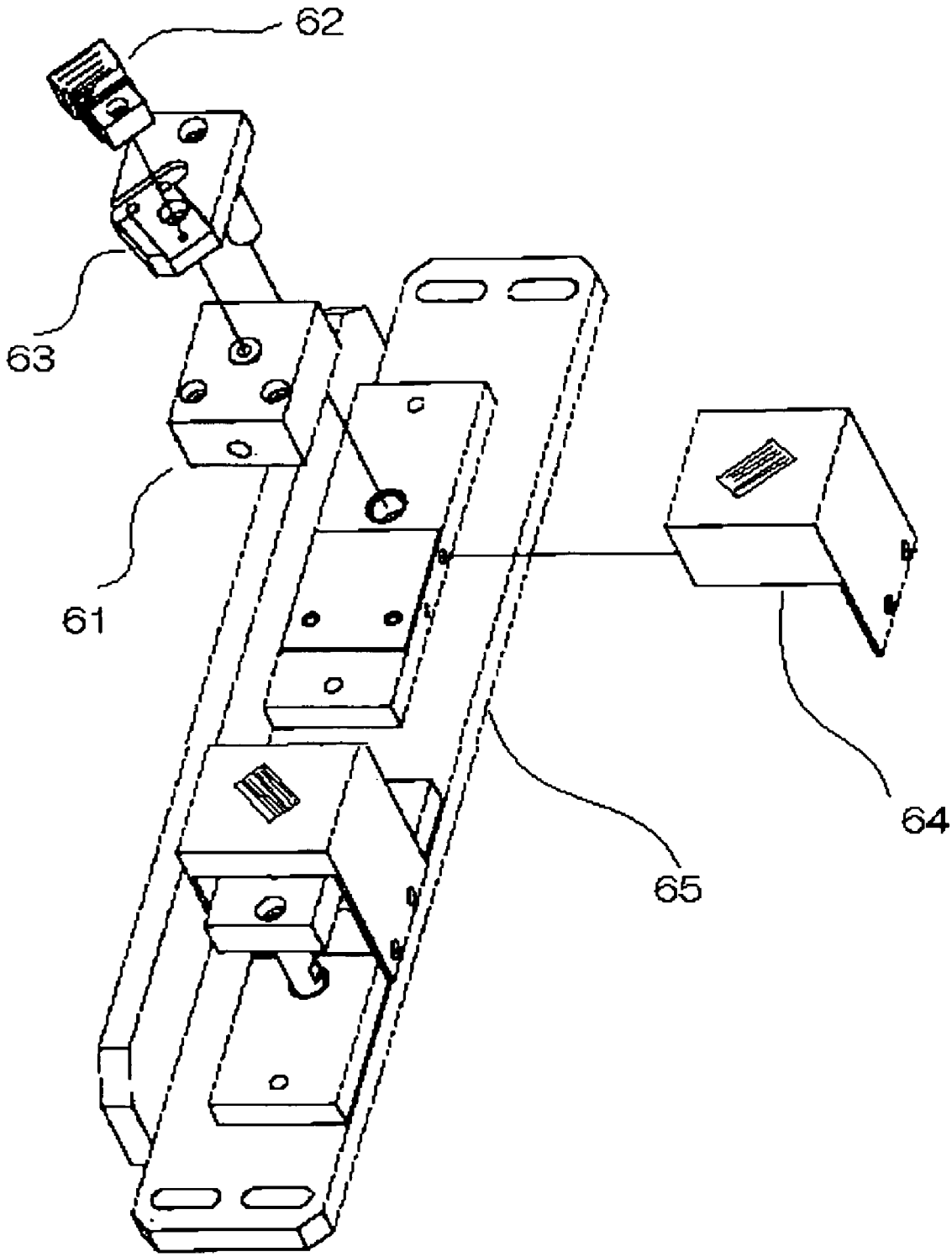
FIG. 9 is an exploded perspective diagram showing a structure of the slit device shown in FIG. 8.

The notch apparatus 60 shown in FIG. 8 is installed in the splice table 53. A desired slit 66 is formed at a top of a guide 64 for the notch blades. In the guide 64 for the notch blades, a notch blade base 63 for the notch blade 62, and the notch blade 62 are assembled, on a base 65, through an air cylinder 61. The notch blade base 63, as well as the notch blade 62, rises by driving the air cylinder 61.

Because the notch blade 62 rises in consonance with the slit 66 of guiding 64 for notch blades, a desired notch is formed at a rear end portion of the currently used packaging material 11*a* controlled by a pressing portion 56 for notch formation.

After notch formation of the currently used packaging material 11*a*, the rear end portion of packaging material 11*a* moves from the pressing portion 56 for notch formation and moves to a heating pressure portion 57.

A front end portion of the next packaging material 11*b* is put on a rear end portion of packaging material 11*a* and is spliced by heating pressure portion 57.

In the illustrated embodiment, two sets of notch 62 are arranged in the notch apparatus 60. Each notch can be driven independently, respectively.

The formation of both or either of the notches is chosen appropriately.

As shown in drawings, it is not necessary that the paper spliced portion is upright to the longitudinal direction of packaging material. The position can be aslant.

As discussed above, the present invention is effective for the heating improvement of the longitudinal seal portion.

For a paper container having a rectangular shape, an example has been explained in which notches are arranged in a corner portion of the packaging material edge. However, by way of example, a six or eight square pillar-shaped paper container, or a wedge form paper container can be used.

Embodiment to form the notch 51 by means of the notch apparatus 60 is described in the above-mentioned example. Before or while supplying to the filling machine, the notches 51 can be formed with a manually operated cutter simply.

Instead of the above-mentioned aluminum foil example, other electromagnetic metallic materials, for instance, compound material by vapor deposition are acceptable.

Advantage

As discussed above, according to this invention, that seal insufficiency generated in the paper spliced portion of the longitudinal seal portion and protection seal of packaging material can be prevented and any interruption of continuous running due to the failure is prevented.

Time and cost consumptions by re-setup of packaging material for use in a re-start, cleaning and disinfection due to the interruption of continuous running of the filling machine are prevented.

INDUSTRIAL APPLICABILITY

A filling machine for manufacturing paper-packaging container according this invention is used in order to pack liquid food of milk, juice, refined sake, shochu, mineral water and other drink.

The invention claimed is:

1. A filling method, comprising:

splicing a front end portion of a web-shaped packaging material of a next reel with a rear end portion of a web-shaped packaging material of a using reel to form a paper spliced portion;

unwinding the web-shaped packaging material from the next reel continually;

forming at least one notch in a metallic material layer of a web edge corner portion heated with electromagnetic induction heating of the paper spliced portion;

longitudinally sealing by electromagnetic induction heating the web packaging material including the metallic material layer to form the web into a tube shape;

filling the packaging material with liquid food;

transversally sealing the tube packaging material to form a seal flap and cutting at the seal flap; and folding the seal flap to form a paper container.

2. A filling machine, comprising:

splicing means for splicing a front end portion of a web-shaped packaging material of a next reel with a rear end portion of a web-shaped packaging material of a using reel to form a paper spliced portion;

means for unwinding the web-shaped packaging material from the next reel continually;

means for longitudinally sealing the web packaging material including a metallic material layer having electromagnetic property to form the web into a tube shape;

means for filling the packaging material with liquid food;

means for transversally sealing the tube packaging material to form a seal flap and cutting at the seal flap, and folding the seal flap to form a paper container;

a longitudinal seal apparatus to longitudinal seal the web-shaped packaging material and form into the tube shape with electromagnetic induction heating of one part or all of the metallic material layer; and a notch formation apparatus forming at least one notch in the metallic material layer of a web edge corner portion heated with electromagnetic induction heating of the paper spliced portion.

3. A filling methods comprising:

splicing a front end portion of a web-shaped packaging material of a next reel with a rear end portion of a web-shaped packaging material of a using reel to form a paper spliced portion;

unwinding the web-shaped packaging material from the next reel continually;

forming at least one notch in a metallic material layer of a web edge corner portion heated with electromagnetic induction heating of the paper spliced portion;

longitudinally sealing by electromagnetic induction heating the web packaging material including the metallic material layer to form the web into a tube shape;

filling the packaging material with liquid food;

transversally sealing the tube packaging material to form a seal flap and cutting at the seal flap; and folding the seal flap to form a paper container;

wherein one part or all of the metallic material layer are heated with electromagnetic induction and an end of the web-shaped packaging material is protected in strip tape with seals.

4. The filling method of claim 1, wherein the at least one notch penetrates entirely through the metallic material layer.

5. The filling method of claim 1, wherein the at least one notch penetrates partially through the metallic material layer.

6. The filling method of claim 1, wherein there are two notches formed, a first notch partially penetrating through the metallic material layer and a second notch entirely penetrating through the metallic material layer.

7. The filling method of claim 3, wherein the at least one notch penetrates entirely through the metallic material layer.

8. The filling method of claim 3, wherein the at least one notch penetrates partially through the metallic material layer.

9. The filling method of claim 3, wherein there are two notches formed, a first notch partially penetrating through the metallic material layer and a second notch entirely penetrating through the metallic material layer.

10. The filling apparatus of claim 2, wherein the notch apparatus includes two notch blades.

* * * * *